US011725854B2

(12) United States Patent
Kuromoto et al.

(10) Patent No.: US 11,725,854 B2
(45) Date of Patent: Aug. 15, 2023

(54) CRYOCOOLER

(71) Applicant: SUMITOMO HEAVY INDUSTRIES, LTD., Tokyo (JP)

(72) Inventors: Takahiro Kuromoto, Nishitokyo (JP); Yosuke Matsumura, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/692,139

(22) Filed: Mar. 10, 2022

(65) Prior Publication Data

US 2022/0290902 A1 Sep. 15, 2022

(30) Foreign Application Priority Data

Mar. 15, 2021 (JP) ..... 2021-041071

(51) Int. Cl.
*F25B 9/14* (2006.01)

(52) U.S. Cl.
CPC ..... *F25B 9/145* (2013.01); *F25B 2309/1421* (2013.01)

(58) Field of Classification Search
CPC .... F16J 15/3268; F16J 15/002; F16J 15/3208; F16J 15/3436; F16J 15/3272; F16F 15/08
See application file for complete search history.

(56) References Cited

U.S. PATENT DOCUMENTS 5,332,361 A * 7/1994 Bras ..... F04D 29/126 277/916

FOREIGN PATENT DOCUMENTS

| | | | |
|---|---|---|---|
| JP | H08303889 | A | 11/1996 |
| JP | 3357719 | B2 | 12/2002 |
| JP | 6117309 | B2 | 4/2017 |

* cited by examiner

*Primary Examiner* — Lionel Nouketcha
(74) *Attorney, Agent, or Firm* — HEA Law PLLC

(57) ABSTRACT

A cryocooler includes a displacer that includes a lid portion and a main body portion, a displacer drive shaft that includes a collar portion held between the lid portion and the main body portion, and a buffer that is disposed in a clearance between the collar portion and the lid portion or between the collar portion and the main body portion and includes a soft material and a hard material disposed on an opposite side to the collar portion with respect to the soft material.

5 Claims, 4 Drawing Sheets

10

CRYOCOOLER

RELATED APPLICATIONS

The content of Japanese Patent Application No. 2021-041071, on the basis of which priority benefits are claimed in an accompanying application data sheet, is in its entirety incorporated herein by reference.

BACKGROUND

Technical Field

A certain embodiment of the present invention relates to a cryocooler.

Description of Related Art

There is a cryocooler that includes a displacer which reciprocates in order to periodically change the volume of an expansion space of a working gas, such as a Gifford-McMahon (GM) cryocooler. By fluctuating the pressure of the expansion space in appropriate synchronization with the periodic volume fluctuations of the expansion space, a refrigeration cycle is configured in the cryocooler.

SUMMARY

According to an embodiment of the present invention, there is provided a cryocooler including a displacer that includes a lid portion and a main body portion, a displacer drive shaft that includes a collar portion held between the lid portion and the main body portion, and a buffer that is disposed in a clearance between the collar portion and the lid portion or between the collar portion and the main body portion and includes a soft material and a hard material disposed on an opposite side to the collar portion with respect to the soft material.

DETAILED DESCRIPTION

As one typical method of driving reciprocation of a displacer, there is a type of mechanically connecting a drive source such as an electric motor to the displacer. A shaft for driving the displacer is mechanically connected to the displacer. From a perspective of improving assembly, or due to dimensional accuracy of a component, slight rattling is provided in this connection portion. Since the periodic pressure fluctuations of a refrigerant gas of an expansion space acts on the displacer during the operation of a cryocooler, the rattling of the connection portion can become a cause of producing vibration in the cryocooler.

It is desirable to reduce the vibration caused by the rattling of the connection portion between the displacer of the cryocooler and a drive shaft thereof.

Hereinafter, an embodiment for carrying out the present invention will be described in detail with reference to the drawings. In the description and drawings, the same or equivalent components, members, and processes will be assigned with the same reference symbols, and redundant description thereof will be omitted as appropriate. The scales and shapes of the shown parts are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
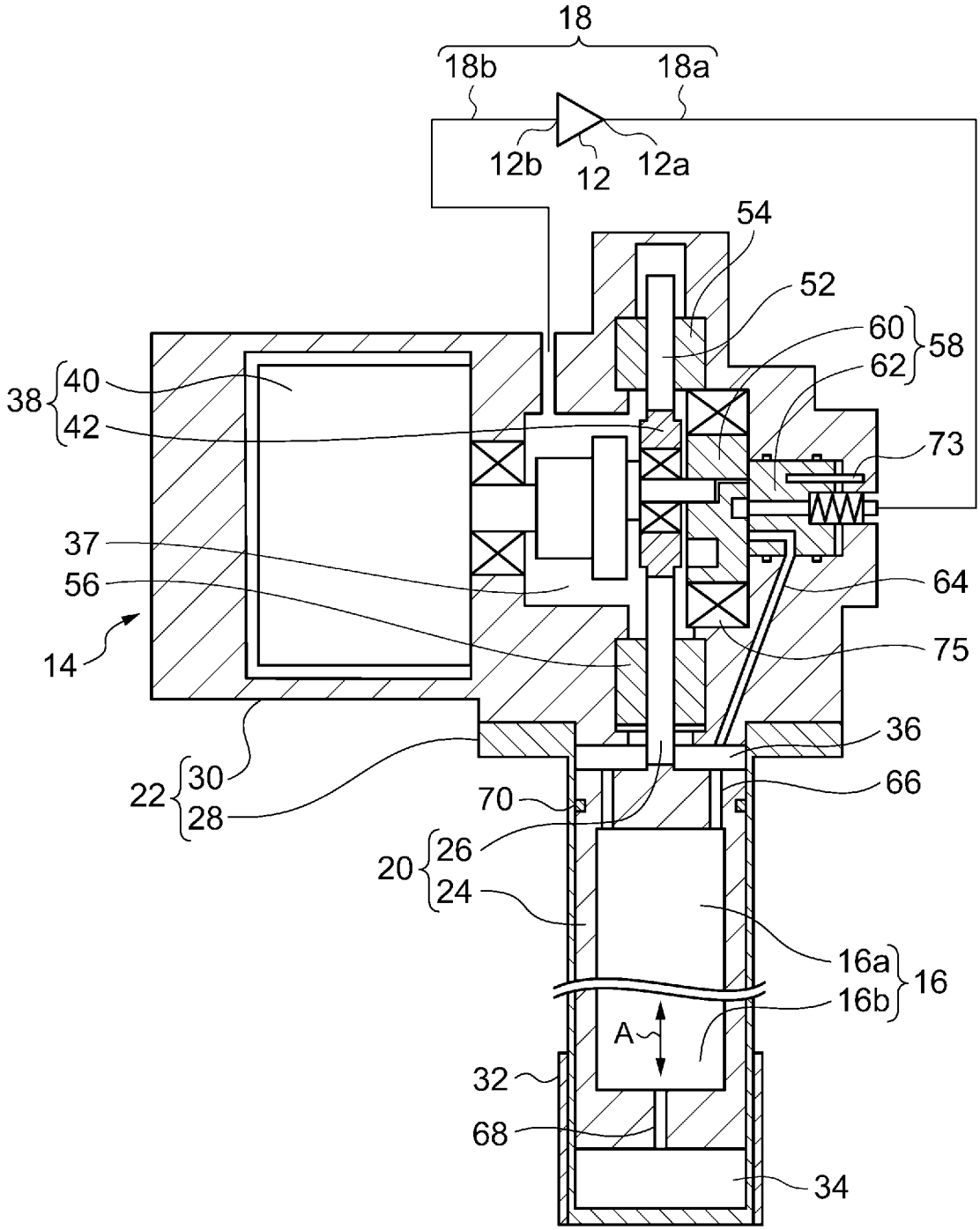
FIG. 1 is a view schematically showing a cryocooler according to one embodiment.
Figure 2:
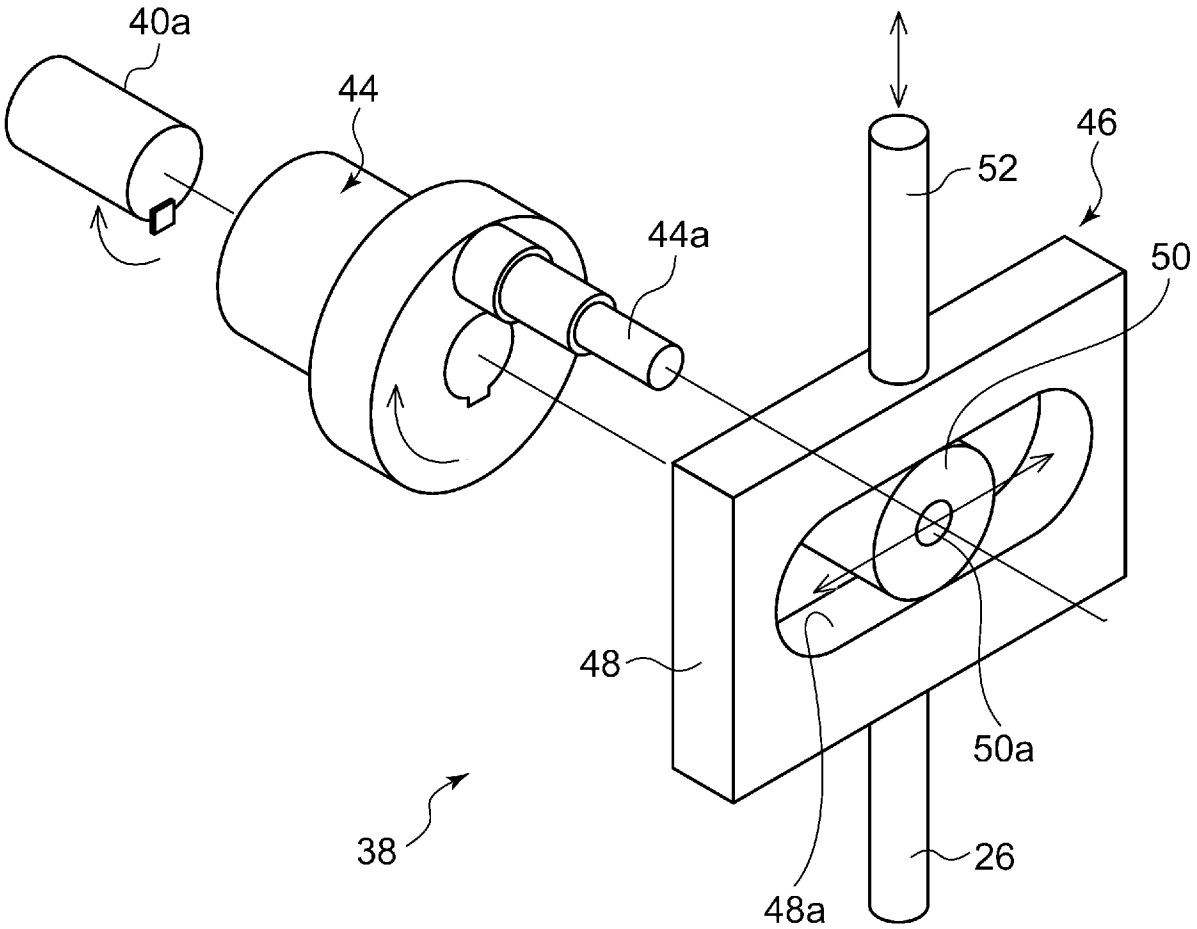
FIG. 2 is an exploded perspective view schematically showing a drive mechanism of an expander of the cryocooler shown in FIG. 1.

FIG. 1 is a view schematically showing a cryocooler according to one embodiment. FIG. 2 is an exploded perspective view schematically showing a drive mechanism of an expander of the cryocooler shown in FIG. 1.

A cryocooler 10 includes a compressor 12 that compresses a working gas (also referred to as a refrigerant gas) and an expander 14 that cools the working gas through adiabatic expansion. The working gas is, for example, a helium gas. The expander 14 is also called a cold head. The expander 14 includes a regenerator 16 that precools the working gas. The cryocooler 10 includes a gas pipe 18 including a first pipe 18*a* and a second pipe 18*b*, each of which connects the compressor 12 and the expander 14 to each other. The cryocooler 10 shown is a single-stage GM cryocooler.

As is known, the working gas having a first high pressure is supplied from a discharge port 12*a* of the compressor 12 to the expander 14 through the first pipe 18*a*. Through the adiabatic expansion in the expander 14, the working gas is depressurized to a second high pressure lower than the first high pressure. The working gas having the second high pressure is collected from the expander 14 to a suction port 12*b* of the compressor 12 through the second pipe 18*b*. The compressor 12 compresses the collected working gas having the second high pressure. In this manner, the working gas is again pressurized to the first high pressure. In general, both of the first high pressure and the second high pressure are considerably higher than the atmospheric pressure. For convenience of description, the first high pressure and the second high pressure will also be simply called a high pressure and a low pressure, respectively. Usually, the high pressure is, for example, 2 to 3 MPa, and the low pressure is, for example, 0.5 to 1.5 MPa. A differential pressure between the high pressure and low pressure is, for example, approximately 1.2 to 2 MPa.

The expander 14 includes an expander movable portion 20 and an expander stationary portion 22. The expander movable portion 20 is configured to be reciprocable in an axial direction (an up-and-down direction in FIG. 1) with respect to the expander stationary portion 22. A moving direction of the expander movable portion 20 is shown by an arrow A in FIG. 1. The expander stationary portion 22 is configured to support the expander movable portion 20 reciprocably in the axial direction. In addition, the expander stationary portion 22 is configured as a hermetic container that accommodates the expander movable portion 20 together with a high pressure gas (including a first high pressure gas and a second high pressure gas).

The expander movable portion 20 includes a displacer 24 and a displacer drive shaft 26 that drives the reciprocation. The regenerator 16 is built in the displacer 24. An internal space of the displacer 24 is filled with a regenerator material, and accordingly, the regenerator 16 is formed in the displacer 24. The displacer 24 has, for example, a substantially cylindrical shape extending in the axial direction, and has a substantially uniform outer diameter and a substantially uniform inner diameter in the axial direction. Accordingly, also the regenerator 16 has a substantially cylindrical shape extending in the axial direction.

The expander stationary portion 22 has a two-part configuration broadly formed by a cylinder 28 and a drive mechanism housing 30. An axially upper portion of the expander stationary portion 22 is the drive mechanism housing 30, an axially lower portion of the expander stationary portion 22 is the cylinder 28, and the axially upper and lower portions are tightly coupled to each other. The cylinder 28 is configured to guide the reciprocation of the displacer 24. The cylinder 28 extends from the drive mechanism housing 30 in the axial direction. The cylinder 28 has a substantially uniform inner diameter in the axial direction, and accordingly, the cylinder 28 has a substantially cylindrical inner surface extending in the axial direction. This inner diameter is slightly larger than the outer diameter of the displacer 24.

In addition, the expander stationary portion 22 includes a cryocooler stage 32. The cryocooler stage 32 is fixed to a terminal end of the cylinder 28 on an opposite side to the drive mechanism housing 30 in the axial direction. The cryocooler stage 32 is provided in order to transmit a chill generated by the expander 14 to another object. The object is attached to the cryocooler stage 32, and is cooled by the cryocooler stage 32 when the cryocooler 10 operates. The cryocooler stage 32 is also called a cooling stage or a heat load stage.

The cylinder 28 is partitioned into an expansion space 34 and an upper space 36 with the displacer 24. The displacer 24 defines the expansion space 34 with the cylinder 28 at one end in the axial direction, and defines the upper space 36 with the cylinder 28 at the other end in the axial direction. The expansion space 34 has a maximum volume at a top dead center of the displacer 24, and has a minimum volume at a bottom dead center of the displacer 24. The upper space 36 has a minimum volume at the top dead center of the displacer 24, and has a maximum volume at the bottom dead center of the displacer 24. The cryocooler stage 32 is fixed to the cylinder 28 to enclose the expansion space 34. The cryocooler stage 32 is thermally coupled to the expansion space 34.

The regenerator 16 includes a regenerator high-temperature section 16*a* on one side (an upper side in the figure) in the axial direction, and includes a regenerator low-temperature section 16*b* on the other side (a lower side in the figure) when the cryocooler 10 operates. In this manner, the regenerator 16 has a temperature distribution in the axial direction. Other components (for example, the displacer 24 and the cylinder 28) of the expander 14 surrounding the regenerator 16 also have an axial temperature distribution in this manner, and therefore, and the expander 14 includes the high-temperature section on the one side in the axial direction and the low-temperature section on the other side in the axial direction when the expander 14 operates. The high-temperature section has, for example, approximately a room temperature. The low-temperature section is cooled to, for example, a temperature included in a range of approximately 100 K to approximately 10 K although the temperature varies depending on the use of the cryocooler 10.

In the specification, for convenience of description, the terms "axial direction", "radial direction", and "circumferential direction" will be used. As shown by the arrow A, the axial direction represents the moving direction of the expander movable portion 20 with respect to the expander stationary portion 22. The radial direction represents a direction (a horizontal direction in the figure) perpendicular to the axial direction, and the circumferential direction represents a direction surrounding the axial direction. An element of the expander 14, which is relatively close to the cryocooler stage 32 in the axial direction, will be called "lower", and an element, which is relatively far, will be called "upper". Accordingly, the high-temperature section and the low-temperature section of the expander 14 are positioned at an upper portion and a lower portion in the axial direction, respectively. Such expressions are used only to help understanding on relative positional relationships between elements of the expander 14, and are not related to the disposition of the expander 14 when provided at the site. For example, the expander 14 may be provided such that the cryocooler stage 32 faces upward and the drive mechanism housing 30 faces downward. Alternatively, the expander 14 may be provided such that the axial direction matches a horizontal direction.

The expander 14 includes a displacer drive mechanism 38 that is supported by the expander stationary portion 22 and drives the displacer 24. The displacer drive mechanism 38 includes a motor 40, such as an electric motor, and a scotch yoke mechanism 42. The displacer drive shaft 26 forms a part of the scotch yoke mechanism 42. The displacer drive shaft 26 is connected to the scotch yoke mechanism 42 so as to be driven by the scotch yoke mechanism 42 in the axial direction. The displacer drive shaft 26 has a diameter smaller than the displacer 24. For example, the diameter of the displacer drive shaft 26 is smaller than half the diameter of the displacer 24.

The displacer drive mechanism 38 is accommodated in a low pressure gas chamber 37 that is defined inside the drive mechanism housing 30. The second pipe 18*b* is connected to the drive mechanism housing 30, and accordingly, the low pressure gas chamber 37 communicates with the suction port 12*b* of the compressor 12 through the second pipe 18*b*. For this reason, the low pressure gas chamber 37 is maintained at the low pressure at all times.

As shown in FIG. 2, the scotch yoke mechanism 42 includes a crank 44 and a scotch yoke 46. The crank 44 is fixed to a rotary shaft 40*a* of the motor 40. The crank 44 includes a crank pin 44*a* at a position eccentric from a position where the rotary shaft 40*a* is fixed. Therefore, when the crank 44 is fixed to the rotary shaft 40*a*, the crank pin 44*a* extends in parallel with the rotary shaft 40*a* of the motor 40 and comes into an eccentric state from the rotary shaft 40*a*.

The scotch yoke 46 includes a yoke plate 48 and a roller bearing 50. The yoke plate 48 is a plate-shaped member. In the scotch yoke 46, an upper rod 52 is connected to extend upward at the center of an upper portion thereof, and the displacer drive shaft 26 is connected to extend downward at the center of a lower portion thereof. At the center of the yoke plate 48, a horizontally long window 48*a* is formed. The horizontally long window 48*a* extends in a direction intersecting a direction (that is, the axial direction) in which the upper rod 52 and the displacer drive shaft 26 extend, and extends, for example, in a direction perpendicular to the direction in which the upper rod 52 and the displacer drive shaft 26 extend. The roller bearing 50 is arranged in the horizontally long window 48*a* so as to be movable rotationally. At the center of the roller bearing 50, an engagement hole 50*a* that engages with the crank pin 44*a* is formed, and the crank pin 44*a* penetrates the engagement hole 50*a*.

When the motor 40 drives and the rotary shaft 40*a* rotates, the roller bearing 50 engaged with the crank pin 44*a* rotates in a circular motion. As the roller bearing 50 rotates in the circular motion, the scotch yoke 46 reciprocates in the axial direction. In this case, the roller bearing 50 reciprocates in the horizontally long window 48*a* in the direction intersecting the axial direction.

As shown in FIG. 1, the displacer drive shaft 26 connects the displacer drive mechanism 38 to the displacer 24. The displacer drive shaft 26 has one end fixed to the yoke plate 48 and the other end fixed to the displacer 24. The displacer drive shaft 26 penetrates the upper space 36 from the low pressure gas chamber 37 and extends to the displacer 24. For this reason, as the scotch yoke 46 moves in the axial direction, the displacer 24 reciprocates in the cylinder 28 in the axial direction.

As shown in FIG. 1, a first sliding bearing 54 and a second sliding bearing 56 are provided in the drive mechanism housing 30 of the expander stationary portion 22. The upper rod 52 is supported by the first sliding bearing 54 so as to be movable in the axial direction, and the displacer drive shaft 26 is supported by the second sliding bearing 56 so as to be movable in the axial direction. Therefore, the upper rod 52, the displacer drive shaft 26, the yoke plate 48, and the scotch yoke 46 are configured to be movable in the axial direction.

A sealing portion such as a slipper seal and a clearance seal is provided at the second sliding bearing 56 or a lower end portion of the drive mechanism housing 30, and is airtightly configured. For this reason, the low pressure gas chamber 37 is isolated from the upper space 36. There is no direct gas flow between the low pressure gas chamber 37 and the upper space 36.

The expander 14 includes a rotary valve 58 that switches between intake and exhaust of the expansion space 34 in synchronization with axial reciprocation of the displacer 24. The rotary valve 58 functions as a part of a supply path for supplying the high pressure gas to the expansion space 34 and functions as a part of an exhaust path for exhausting a low pressure gas from the expansion space 34. The rotary valve 58 is configured to switch between a supply function and an exhaust function of the working gas in synchronization with the reciprocation of the displacer 24 and accordingly to control the pressure of the expansion space 34. The rotary valve 58 is connected to the displacer drive mechanism 38 and is accommodated in the drive mechanism housing 30.

In addition, the expander 14 includes a housing gas flow path 64, a displacer upper lid gas flow path 66, and a displacer lower lid gas flow path 68. The high pressure gas flows from the first pipe 18*a* into the expansion space 34 via the rotary valve 58, the housing gas flow path 64, the upper space 36, the displacer upper lid gas flow path 66, the regenerator 16, and the displacer lower lid gas flow path 68. A return gas from the expansion space 34 is received by the low pressure gas chamber 37 via the displacer lower lid gas flow path 68, the regenerator 16, the displacer upper lid gas flow path 66, the upper space 36, the housing gas flow path 64, and the rotary valve 58.

The housing gas flow path 64 is formed to penetrate the drive mechanism housing 30 for a gas flow between the expander stationary portion 22 and the upper space 36.

The upper space 36 is formed on a side of the regenerator high-temperature section 16*a* between the expander stationary portion 22 and the displacer 24. More specifically, the upper space 36 is sandwiched between the drive mechanism housing 30 and the displacer 24 in the axial direction, and is surrounded by the cylinder 28 in the circumferential direction. The upper space 36 is adjacent to the low pressure gas chamber 37. The upper space 36 is also called a room temperature chamber. The upper space 36 is formed between the expander movable portion 20 and the expander stationary portion 22 and has a variable volume.

The displacer upper lid gas flow path 66 is at least one opening of the displacer 24, which is formed such that the regenerator high-temperature section 16*a* communicates with the upper space 36. The displacer lower lid gas flow path 68 is at least one opening of the displacer 24, which is formed such that the regenerator low-temperature section 16*b* communicates with the expansion space 34. A sealing portion 70 that seals a clearance between the displacer 24 and the cylinder 28 is provided in a side surface of the displacer 24. The sealing portion 70 may be attached to the displacer 24 to surround the displacer upper lid gas flow path 66 in the circumferential direction.

The expansion space 34 is formed on a side of the regenerator low-temperature section 16*b* between the cylinder 28 and the displacer 24. Like the upper space 36, the expansion space 34 is formed between the expander movable portion 20 and the expander stationary portion 22 and has a variable volume, and the volume of the expansion space 34 varies complementary to the volume of the upper space 36 due to a relative movement of the displacer 24 with respect to the cylinder 28. Since the sealing portion 70 is provided, there is no direct gas flow between the upper space 36 and the expansion space 34 (that is, a gas flow bypassing the regenerator 16).

The rotary valve 58 includes a rotor valve member 60 and a stator valve member 62. The rotor valve member 60 is connected to the rotary shaft 40*a* of the motor 40 so as to rotate in response to the rotation of the motor 40. The rotor valve member 60 is in surface-contact with the stator valve member 62 so as to rotate and slide with respect to the stator valve member 62. The rotor valve member 60 is rotatably supported in the drive mechanism housing 30 by a rotor valve bearing 75 shown in FIG. 1. The stator valve member 62 is fixed in the drive mechanism housing 30 by a stator valve fixing pin 73. The stator valve member 62 is configured to receive the high pressure gas entering the drive mechanism housing 30 from the first pipe 18*a*.

Figure 3A:
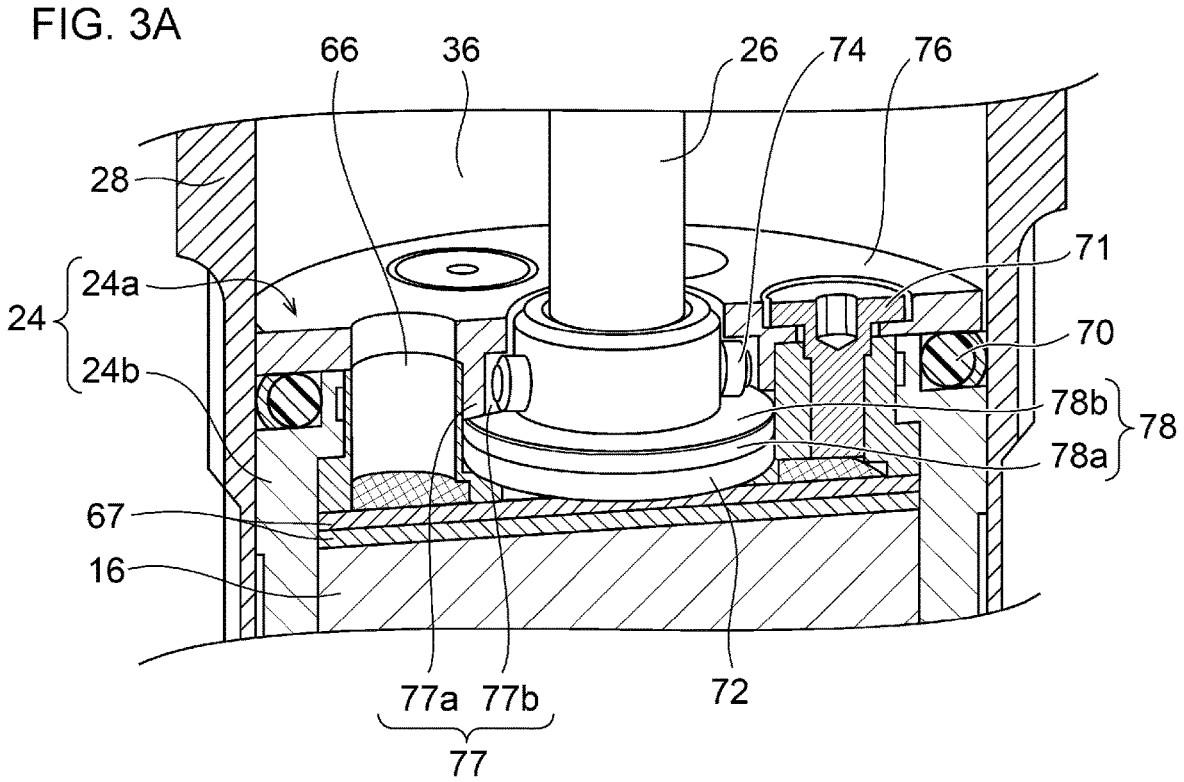
FIGS. 3A and 3B are a partially cutaway perspective view and a cross sectional view showing a connection portion between a displacer and a displacer drive shaft according to the embodiment, respectively.
Figure 3B:
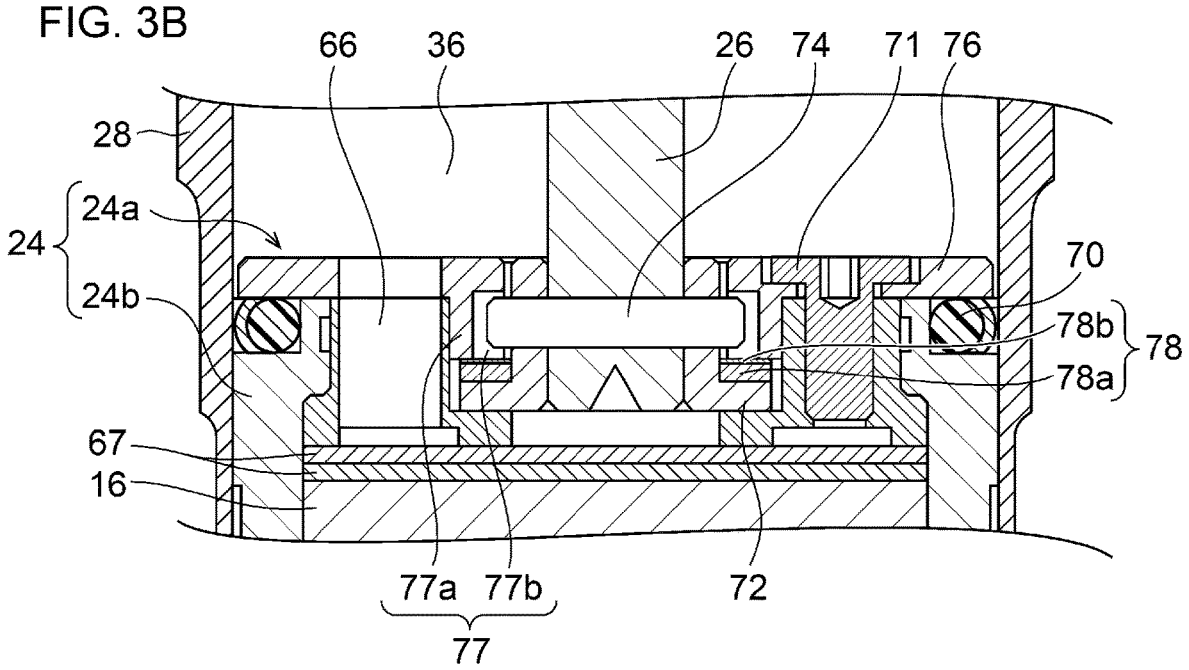
Figure 4A:
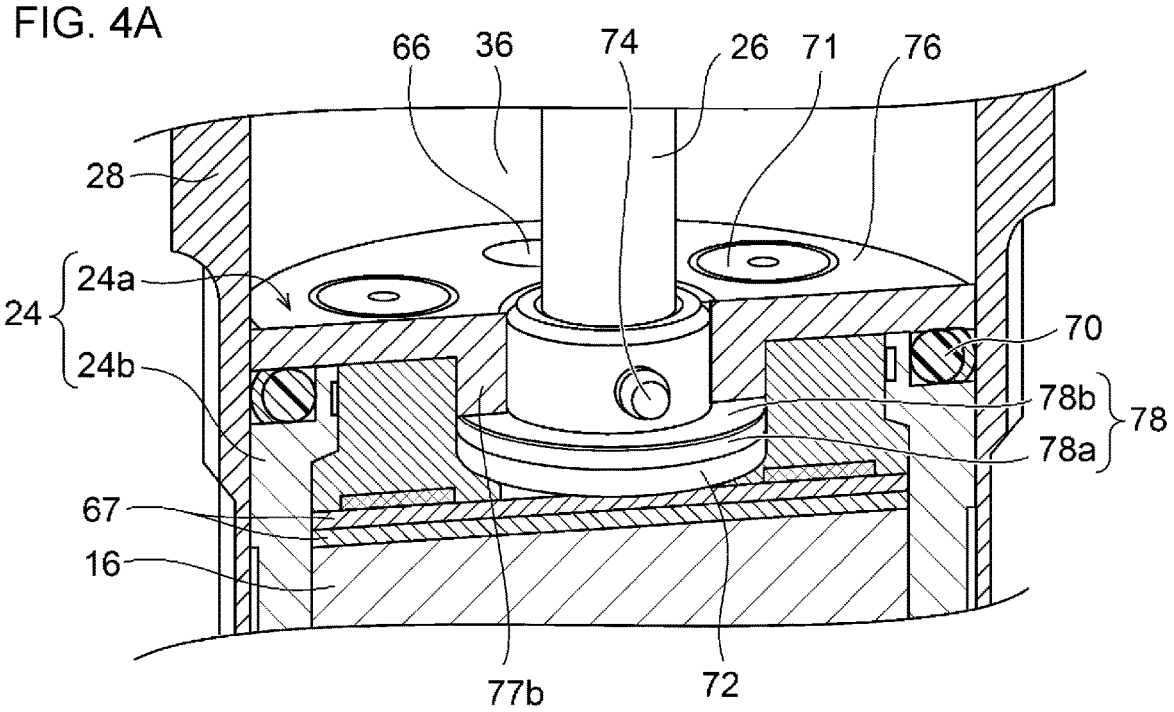
FIGS. 4A and 4B are a partially cutaway perspective view and a cross sectional view showing the connection portion between the displacer and the displacer drive shaft according to the embodiment, which is viewed from a direction different from FIGS. 3A and 3B, respectively.
Figure 4B:
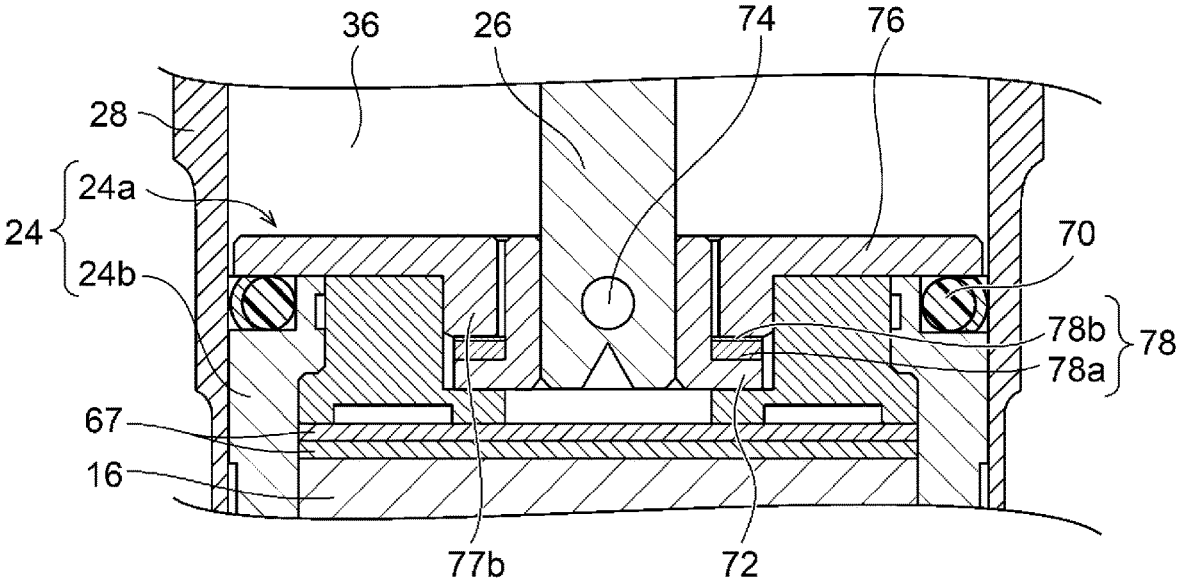

FIGS. 3A and 3B are a partially cutaway perspective view and a cross sectional view showing a connection portion between the displacer 24 and the displacer drive shaft 26 according to the embodiment, respectively. The cross section shown in FIGS. 3A and 3B is a cross section taken along a plane including a center axis of the displacer drive shaft 26. In addition, FIGS. 4A and 4B are a partially cutaway perspective view and a cross sectional view showing the connection portion between the displacer 24 and the displacer drive shaft 26 according to the embodiment, which is viewed from a direction different from FIGS. 3A and 3B, respectively. The cross section shown in FIGS. 4A and 4B is a cross section taken along a plane that includes the center axis of the displacer drive shaft 26 and is perpendicular to the cross section of FIGS. 3A and 3B.

The displacer 24 includes a lid portion 24*a* and a main body portion 24*b*. The lid portion 24*a* is an upper lid of the displacer 24, and has a disk shape. The lid portion 24*a* is formed of a metal material or other material. The lid portion 24*a* may be formed of, for example, an alumite-treated aluminum alloy. The main body portion 24*b* has a cylindrical shape extending in an axial direction of the displacer 24 and includes the regenerator 16 therein. The main body portion 24*b* is formed of a synthetic resin material or other material. The main body portion 24*b* may be formed of a phenol resin such as polyoxybenzylmethylenglycolanhydride, better known as BAKELITE.

The lid portion 24*a* is fixed to an upper end of the main body portion 24*b* in the axial direction by a fastening member 71 such as a bolt. A plurality of fastening members 71 are provided so as to surround the displacer drive shaft 26 at equal angular intervals in the circumferential direction, each are inserted from the lid portion 24*a* into the main body portion 24*b* in the axial direction, and fasten the lid portion 24*a* and the main body portion 24*b* to each other. The lid portion 24*a* and the main body portion 24*b* may be fixed to each other through other methods such as bonding.

The displacer upper lid gas flow path 66 described above is formed by penetrating the lid portion 24*a* and an upper end portion of the main body portion 24*b* in the axial direction. A plurality of displacer upper lid gas flow paths 66 are provided so as to surround the displacer drive shaft 26 at equal angular intervals in the circumferential direction. The displacer upper lid gas flow paths 66 are disposed in the circumferential direction alternately with the fastening members 71 at the same radial position as the fastening member 71. The displacer upper lid gas flow paths 66 (and/or the fastening members 71) may be disposed at irregular intervals in the circumferential direction.

For example, a rectifying layer 67 formed of at least one wire mesh is provided between the upper end portion of the main body portion 24*b* and the regenerator 16. The rectifying layer 67 may be formed of a plurality of wire meshes having wire diameters and/or meshes which are different from each other or the same. The refrigerant gas flowing between the upper space 36 and the displacer 24 (regenerator 16) passes through the rectifying layer 67 from the displacer upper lid gas flow path 66 and flows to the regenerator 16 (or in an opposite direction thereto).

The sealing portion 70 that seals a refrigerant gas flow to the clearance between the displacer 24 and the cylinder 28 is sandwiched between respective outermost peripheral portions of the lid portion 24*a* and the main body portion 24*b*, and is provided in the side surface of the displacer 24. The sealing portion 70 may be an appropriate sealing member such as a slipper seal.

The displacer drive shaft 26 includes a collar portion 72 held between the lid portion 24*a* and the main body portion 24*b*. The collar portion 72 is provided at a lower end of the displacer drive shaft 26 in the axial direction, and extends to a radially outer side. The collar portion 72 has a circular shape when viewed from an axial direction of the shaft. The displacer drive shaft 26 and the collar portion 72 are formed of a metal material or other material. The displacer drive shaft 26 is connected to the displacer 24 as the collar portion 72 is sandwiched between the lid portion 24*a* and the main body portion 24*b*.

The collar portion 72 is pin-coupled to the displacer drive shaft 26 by a connecting pin 74 inserted in the radial direction. The collar portion 72 includes a short tubular portion into which the lower end of the displacer drive shaft 26 in the axial direction is inserted, and a pin hole penetrating the short tubular portion and the displacer drive shaft 26 along a shaft diameter when the displacer drive shaft 26 is inserted into the short tubular portion is formed. The connecting pin 74 is inserted into the pin hole, and the collar portion 72 is attached to the displacer drive shaft 26. The connecting pin 74 is disposed between the lid portion 24*a* and the main body portion 24*b*, together with the collar portion 72.

The lid portion 24*a* includes a plate-shaped portion 76 and a peripheral wall portion 77. The plate-shaped portion 76 is attached to the main body portion 24*b* by the fastening member 71 described above, and the displacer drive shaft 26 penetrates a central portion of the plate-shaped portion 76. The peripheral wall portion 77 protrudes from the plate-shaped portion 76 toward the main body portion 24*b* so as to surround the displacer drive shaft 26 at an axial height where the connecting pin 74 is inserted. The peripheral wall portion 77 includes thin portions 77*a* that become thin in the radial direction and are arranged radially outward of both ends of the connecting pin 74 and a thick portion 77*b* that connects the thin portions 77*a* to each other in the circumferential direction. The thin portion 77*a* forms, in the peripheral wall portion 77, a recessed portion that receives a respective end of the connecting pin 74. Since a step between the thin portion 77*a* and the thick portion 77*b* engages with an end portion of the connecting pin 74 in the circumferential direction, the step works as a detent of the collar portion 72 with respect to the lid portion 24*a*, that is, a detent of the displacer drive shaft 26 with respect to the displacer 24.

The upper end portion of the main body portion 24*b* includes a circular recessed portion in a central portion thereof, and the lower end of the displacer drive shaft 26, the collar portion 72, and the peripheral wall portion 77 are received in the recessed portion. The displacer upper lid gas flow path 66 and the fastening member 71, which are described above, are disposed on the radially outer side of the recessed portion.

A buffer 78 is disposed in a clearance between the collar portion 72 and the lid portion 24*a*. The buffer 78 includes a soft material 78*a* and a hard material 78*b* disposed on an opposite side to the collar portion 72 with respect to the soft material 78*a*. The hard material 78*b* is in contact with the soft material 78*a* on one side, and is in contact with the peripheral wall portion 77 of the lid portion 24*a* on an opposite side.

The soft material 78*a* may be an elastic body, and may be formed of an elastically deformable synthetic resin material such as rubber. The hard material 78*b* may be formed of a material harder than the soft material 78*a*, for example, a metal material such as stainless steel. The hard material 78*b* may be formed of a synthetic resin material such as plastic harder than the soft material 78*a*. For example, the soft material 78*a* may be a washer made of rubber, and the hard material 78*b* may be a shim ring made of a metal.

The buffer 78 has a ring shape disposed around the displacer drive shaft 26 along the collar portion 72. Accordingly, the soft material 78*a* has a ring shape disposed around the displacer drive shaft 26 on the collar portion 72. In the embodiment, the ring shape of the soft material 78*a* has a rectangular cross section of which a radial width is larger than an axial thickness along the displacer drive shaft 26 as shown in FIGS. 3B and 4B. The hard material 78*b* has a ring shape disposed around the displacer drive shaft 26 on the soft material 78*a*. The axial thickness of the hard material 78*b* is smaller than the axial thickness of the soft material 78*a*.

The soft material 78*a* is housed between the hard material 78*b* and the collar portion 72, and does not project from the hard material 78*b* and the collar portion 72 in the radial direction. As shown, the inner diameter and the outer diameter of the soft material 78*a* are equal to the inner diameter and the outer diameter of the hard material 78*b*, respectively. In addition, the inner diameter and the outer diameter of the soft material 78*a* are equal to the inner diameter and the outer diameter of the collar portion 72, respectively. Accordingly, the entire surface of the soft material 78*a* on one side is in contact with the hard material 78*b*, and the entire surface on an opposite side is in contact with the collar portion 72. A contact surface between the hard material 78*b* and the soft material 78*a* is flat, and a contact surface between the collar portion 72 and the soft material 78*a* is also flat.

The inner diameter of the soft material 78*a* may be somewhat larger than the inner diameters of the hard material 78*b* and/or the collar portion 72. In addition, the outer diameter of the soft material 78*a* may be somewhat smaller than the outer diameters of the hard material 78*b* and/or the collar portion 72.

An area where the hard material 78*b* is in contact with the soft material 78*a* is larger than an area where the hard material 78*b* is in contact with the lid portion 24*a*. While the entire surface of the hard material 78*b* on the one side (a lower side in the figure) is in contact with the entire surface of the soft material 78*a*, a part of a surface on the opposite side (an upper side in the figure) is in contact with the lid portion 24*a*. The peripheral wall portion 77 of the lid portion 24*a* is in contact with the hard material 78*b* at the thin portion 77*a* and the thick portion 77*b*. Below each of both ends of the connecting pin 74 in the axial direction, the hard material 78*b* and the peripheral wall portion 77 are not in contact with each other.

A total of an initial thickness of the soft material 78*a* (that is, a thickness before a state where the buffer 78 is held between the lid portion 24*a* and the collar portion 72) and the axial thickness of the hard material 78*b* is slightly larger than an axial distance between the collar portion 72 and the peripheral wall portion 77 of the lid portion 24*a*. For this reason, when the buffer 78 is attached between the lid portion 24*a* and the collar portion 72, the soft material 78*a* is sandwiched between the hard material 78*b* and the collar portion 72 in a compressed state (slightly crushed state).

In this manner, the collar portion 72 is sandwiched between the peripheral wall portion 77 of the lid portion 24*a* and the main body portion 24*b* in the recessed portion of the main body portion 24*b* together with the buffer 78, and the displacer drive shaft 26 is connected to the displacer 24.

The configuration of the cryocooler 10 according to the embodiment has been described hereinbefore. Next, an operation thereof will be described. When the displacer 24 is at a bottom dead center or in the vicinity thereof, the rotary valve 58 switches to connect the discharge port 12*a* of the compressor 12 to the expansion space 34, and an intake process of a refrigeration cycle is started. The high pressure gas enters the regenerator high-temperature section 16*a* from the rotary valve 58 through the housing gas flow path 64, the upper space 36, and the displacer upper lid gas flow path 66. The gas is cooled while passing through the regenerator 16, and enters the expansion space 34 from the regenerator low-temperature section 16*b* through the displacer lower lid gas flow path 68. While the gas flows into the expansion space 34, the displacer drive shaft 26 causes the displacer 24 to move axially upward in the cylinder 28 from the bottom dead center toward the top dead center. Accordingly, the volume of the expansion space 34 is increased. In this manner, the expansion space 34 is filled with the high pressure gas.

When the displacer 24 is at the top dead center or in the vicinity thereof, the rotary valve 58 switches to connect the suction port 12*b* of the compressor 12 to the expansion space 34, and an exhaust process of the refrigeration cycle is started. In this case, the high pressure gas in the expansion space 34 expands and is cooled. The expanded gas enters the regenerator 16 from the expansion space 34 through the displacer lower lid gas flow path 68. The gas is cooled while passing through the regenerator 16. The gas returns to the compressor 12 from the regenerator 16 via the housing gas flow path 64, the rotary valve 58, and the low pressure gas chamber 37. While the gas flows out from the expansion space 34, the displacer drive shaft 26 causes the displacer 24 to move axially downward in the cylinder 28 from the top dead center toward the bottom dead center. Accordingly, the volume of the expansion space 34 is decreased, and the low pressure gas is exhausted from the expansion space 34. When the exhaust process is terminated, the intake process is started again.

The description above is one refrigeration cycle in the cryocooler 10. By repeating the refrigeration cycle, the cryocooler 10 cools the cryocooler stage 32 to a desired temperature. Accordingly, the cryocooler 10 can cool an object thermally coupled to the cryocooler stage 32 to a cryogenic temperature.

In the embodiment, when the displacer drive shaft 26 is attached to the displacer 24, the buffer 78 is sandwiched between the lid portion 24*a* and the main body portion 24*b* of the displacer together with the collar portion 72. The buffer 78 can completely fill or at least reduce the clearance between the collar portion 72 and the lid portion 24*a*, and accordingly, the vibration of the displacer 24 with respect to the displacer drive shaft 26, which can be caused during the operation of the cryocooler 10, can be prevented or reduced.

In addition, the hard material 78*b* is in contact with the soft material 78*a* on the one side and is in contact with the lid portion 24*a* on an opposite side, and the area where the hard material 78*b* is in contact with the soft material 78*a* is larger than an area where the hard material 78*b* is in contact with the lid portion 24*a* or the main body portion 24*b*. In a case where there is no hard material 78*b*, the lid portion 24*a* (for example, the thin portion 77*a* of the peripheral wall portion 77) is directly pressed against the soft material 78*a*, and the soft material 78*a* becomes locally deformed at a pressed portion and can be further damaged. However, in the embodiment, a tightening force acting on the buffer 78 as the buffer 78 is sandwiched between the lid portion 24*a* and the collar portion 72 is transmitted from the lid portion 24*a* to the soft material 78*a* via the hard material 78*b*. A contact pressure caused by the tightening force is made uniform by the hard material 78*b*, and local deformation or damage of the soft material 78*a* can be prevented or reduced.

The soft material 78*a* is sandwiched between the hard material 78*b* and the collar portion 72 in a compressed state. For this reason, the buffer 78 can completely fill the clearance between the collar portion 72 and the lid portion 24*a*, and the vibration of the displacer 24 with respect to the displacer drive shaft 26 can be more effectively prevented or reduced.

The ring shape of the soft material 78*a* has the rectangular cross section of which the radial width is larger than the axial thickness along the displacer drive shaft 26. The buffer 78 is to be suitable for the dimension of the clearance between the collar portion 72 and the lid portion 24*a*, but the clearance has a considerably small axial height. When an O-ring having a general circular cross section is used as the soft material 78*a*, an O-ring having a considerably small width is necessary so as to be suitable for the axial height of the clearance, and there is a concern that a buffering effect lessens. Since the ring shape of the soft material 78*a* has the rectangular cross section of which the radial width is larger than the axial thickness in the present embodiment, such inconvenience is avoided.

The present invention has been described based on the example. It is clear for those skilled in the art that the present invention is not limited to the embodiments, various design changes are possible, various modification examples are possible, and such modification examples are also within the scope of the present invention. Various characteristics described in relation to one embodiment are also applicable to other embodiments. A new embodiment generated through combination also has the effects of each of the combined embodiments.

The buffer 78 is disposed between the collar portion 72 and the lid portion 24*a* in the embodiment described above, but instead thereof (or in addition thereto), may be disposed in a clearance between the collar portion 72 and the main body portion 24*b*. The buffer 78 may include the soft material 78*a* and the hard material 78*b* disposed on the opposite side to the collar portion 72 with respect to the soft material 78*a*. The hard material 78*b* may be in contact with the soft material 78*a* on the one side, and be in contact with the main body portion 24*b* on the opposite side. The area where the hard material 78*b* is in contact with the soft material 78*a* may be larger than an area where the hard material 78*b* is in contact with the main body portion 24*b*.

In order to make the axial height of the clearance suitable, the soft material 78*a* may be a plurality of soft materials (for example, a plurality of washers made of rubber). Similarly, the hard material 78*b* may be a plurality of hard materials (for example, a plurality of shim rings).

The buffer 78 (the soft material 78*a* and/or the hard material 78*b*) does not necessarily have to be a single ring-shaped member. The buffer 78 may be a plurality of divided portions, and the portions may be disposed in a ring shape in the circumferential direction of the displacer drive shaft 26 along the collar portion 72.

Another hard material 78*b* may also be inserted between the soft material 78*a* and the collar portion 72 according to the shape of the collar portion 72, for example, a groove or unevenness is provided in the surface of the collar portion 72.

In the above description, the embodiment has been described by referring to the single-stage GM cryocooler. The present invention is not limited thereto, and the buffer 78 according to the embodiment is applicable to a two-stage or a multi-stage GM cryocooler or other cryocooler including the connection portion between the displacer and the displacer drive shaft.

Although the present invention has been described using specific phrases based on the embodiment, the embodiment merely shows one aspect of the principles and applications of the present invention, and many modification examples and changes in disposition are allowed without departing from the gist of the present invention defined in the claims.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

a displacer that includes a lid portion and a main body portion;

a displacer drive shaft that includes a collar portion held between the lid portion and the main body portion; and a buffer that is disposed in a clearance between the collar portion and the lid portion, or between the collar portion and the main body portion, wherein the buffer includes a soft material and a hard material, wherein the soft material is disposed between the collar portion and the hard material, and wherein the soft material is an elastic body and the hard material is harder than the soft material.

2. The cryocooler according to claim 1, wherein the hard material is in contact with the soft material on one side and is in contact with the lid portion or the main body portion on an opposite side, and wherein an area where the hard material is in contact with the soft material is larger than an area where the hard material is in contact with the lid portion or the main body portion.

3. The cryocooler according to claim 2, wherein the collar portion is pin-coupled to the displacer drive shaft by a connecting pin inserted in a radial direction, and the connecting pin is disposed between the lid portion and the main body portion together with the collar portion, wherein the lid portion includes a plate-shaped portion that is attached to the main body portion and is penetrated by the displacer drive shaft and a peripheral wall portion that protrudes from the plate-shaped portion toward the main body portion so as to surround the displacer drive shaft at an axial height where the connecting pin is inserted, and wherein the peripheral wall portion includes thin portions that become thin in the radial direction and are arranged radially outward of both ends of the connecting pin and a thick portion that connects the thin portions to each other in a circumferential direction, and is in contact with the hard material at the thin portion and the thick portion.

4. The cryocooler according to claim 1, wherein the soft material is sandwiched between the hard material and the collar portion in a compressed state.

5. The cryocooler according to claim 1, wherein the collar portion extends in a radial direction at a tip part of the displacer drive shaft, and wherein the soft material has a ring shape disposed around the displacer drive shaft on the collar portion, and the ring shape has a rectangular cross section of which a radial width is larger than an axial thickness along the displacer drive shaft.

* * * * *